United States Patent [19]

Hanning

[11] Patent Number: 4,685,887

[45] Date of Patent: Aug. 11, 1987

[54] ELECTRICAL CONNECTOR ARRANGEMENT WITH A SHORT-CIRCUIT BRIDGE

[75] Inventor: Walter Hanning, Hiddenhausen, Fed. Rep. of Germany

[73] Assignee: C.A. Weidmüller GmbH & Co., Detmold, Fed. Rep. of Germany

[21] Appl. No.: 930,510

[22] Filed: Nov. 12, 1986

[30] Foreign Application Priority Data

Nov. 13, 1985 [DE] Fed. Rep. of Germany ... 8531990[U]

[51] Int. Cl.[4] ..... H01R 13/703

[52] U.S. Cl. ..... 439/188; 200/51.1

[58] Field of Search ..... 339/19, 111, 222; 200/51.09, 51.1

[56] References Cited

U.S. PATENT DOCUMENTS 4,070,557 1/1978 Ostapovich ..... 339/19

FOREIGN PATENT DOCUMENTS 7911166 4/1979 Fed. Rep. of Germany .

*Primary Examiner*—Neil Abrams

*Attorney, Agent, or Firm*—Erwin S. Teltscher

[57] ABSTRACT

An electrical double plug and socket connector includes a socket component, a plug component and a short-circuit bridge. Each of the socket and plug components includes an insulating material housing. Metallic contacts are arranged in the socket component housing, and associated metallic connecting elements are arranged in the plug component housing. The plug component housing bounds a receiving space located between the connecting elements. The short-circuit bridge includes a U-shaped spring accommodated in the receiving space but having two arms which project axially out of the receiving space toward associated insulating material lugs of the socket component housing to such an extent that the connecting elements project beyond the arms by more than the distance by which the lugs extend beyond the contacts. The arms have respective contact webs which respectively extend toward and resiliently contact associated inwardly facing surface portions of the connecting elements in an inoperative position of the components, so that the short-circuit bridge provides a short-circuit connection between the connecting elements, and actuating portions which respectively extend into the path of movement of the lugs toward an operative position, so that the contact webs are resiliently moved away from the connecting elements and the short-circuit connection is interrupted.

2 Claims, 1 Drawing Figure

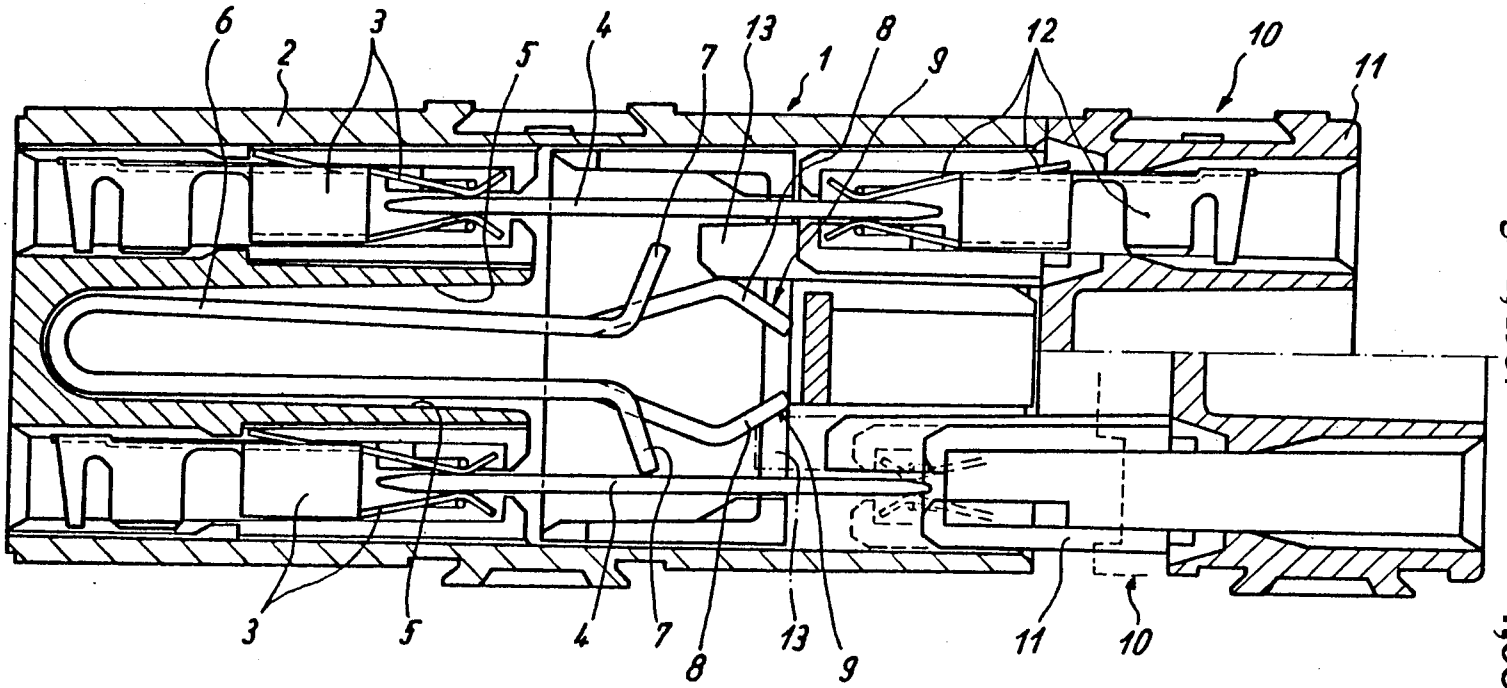
11
10
12
9
8
1
13
7
4
5
3
2
6
10
11
9
13
8
7
4
5
3

ELECTRICAL CONNECTOR ARRANGEMENT WITH A SHORT-CIRCUIT BRIDGE

BACKGROUND OF THE INVENTION

The present invention relates to electrical connector arrangements in general, and more particularly to a double plug and socket connector with a short-circuit bridge.

There are already known various electrical connector arrangements, among them double connectors of the plug and socket type. A connector of the latter type may include a plug component having a housing made of an electrically insulating material and two metallic connecting elements arranged in the plug component housing, and a socket component also having a housing made of an electrically insulating material and two metallic contacts arranged in the plug component housing. Then, a resilient short-circuit bridge associated with the connecting elements may be further provided in the plug component housing, and the socket component housing may be provided with insulating material lugs which resiliently move the spring out of contact with the connecting elements as the two components approach their fully assembled position. The connecting elements of the plug component may extend a larger distance beyond the spring than the insulating material lugs extend beyond the contacts.

A double plug and socket connector arrangement of this type is disclosed, for instance, in the German utility model DE-GM No. 7 911 166, in an implementation involving a testing terminal with an associated separating plug. As a result of the above-mentioned construction, making a faulty contact is effectively avoided in such a plug-in connector, due to the provision of the short-circuit bridge. Double plug and socket connectors of this kind are being used, for example, in situations where it must be assured at each instant of time that an electrical secondary current circuit is open, inasmuch as dangerous voltages may otherwise occur.

In this connection, there may be contemplated, for instance, a situation where a testing instrument is to be included into such secondary current circuit, or a situation where a current measuring device fed by a current transducer is to be taken out of circuit or exchanged. Owing to the above-mentioned construction of the plug and socket connector, the secondary current circuit of the plug component is closed through the short-circuit bridge at first, when the socket component is not yet inserted into or otherwise assembled with the plug component.

Then, as the socket and plug components are being assembled with one another, there is initially available an assembling movement distance or a time period, during which the connecting elements of the plug component already contact the contacts of the socket component, while the short-circuit bridge in the plug component is still simultaneously effective. The short-circuiting effect of the short-circuit bridge is then eliminated only during a further phase of the assembly of the plug and socket components as they approach their fully assembled position, in that the insulating material lugs of the socket component resiliently move the resilient short-circuit bridge away from the connecting elements of the plug components.

In the known construction mentioned above, the short-circuit bridge consists of a spring element of a complicated configuration and construction which acts on the mutually parallel outwardly facing surfaces of the respective contact elements from the outside. Because of the complexity of construction and configuration of the spring element, a very complicated mounting operation is required for the positional fixation of the spring element in the insulating material housing of the plug component.

SUMMARY OF THE INVENTION

Accordingly, it is a general object of the present invention to avoid the disadvantages of the prior art.

More particularly, it is an object of the present invention to provide a double plug and socket connector arrangement which does not possess the drawbacks of the known arrangements of this type.

Still another object of the present invention is to devise an arrangement of the type here under consideration which would include a short-circuit bridge that can be mounted on the associated component of the connector in an easy and simple manner.

It is yet another object of the present invention to design the above arrangement in such a manner that the short-circuit bridge occupies only a relatively small amount of space in the associated component.

A concomitant object of the present invention is so to construct the arrangement of the above type as to be relatively simple in construction, inexpensive to manufacture, easy to use, and yet reliable in operation.

In keeping with these objects and others which will become apparent hereafter, one feature of the present invention resides in an electrical double plug and socket connector which comprises a socket component including a first insulating material housing centered on an axis and having two axially spaced ends, two metallic contacts arranged in the first insulating material housing, and insulating material lugs mounted on the first insulating material housing and projecting substantially axially from one of the ends to a predetermined distance beyond the contacts. This arrangement further includes a plug component guided on the socket component for axial movement between at least one inoperative and one operative position and including a second insulating material housing having two spaced axial ends one of which faces the one end of the socket component in the positions and bounding a centrally located receiving space which is open toward the one axial end of the plug component, and two metallic connecting elements arranged in the second insulating material housing outwardly of and projecting axially beyond the receiving space and each having an inwardly facing surface portion. The arrangement also includes a resilient short-circuit bridge including a substantially U-shaped spring arranged between the two connecting elements, predominantly accommodated in the receiving space of the second insulating material housing, and having two arms having respective end portions projecting axially out of the receiving space toward the insulating material lugs of the first insulating material housing to such an extent that the connecting elements project beyond the end portions of the arms by more than the predetermined distance. The end portions of the arms have respective contact webs which respectively extend toward and resiliently contact the associated ones of the inwardly facing surface portions of the connecting elements in the inoperative position for the short-circuit bridge to provide a short-circuit connection between the connecting elements, and actuating portions which respectively extend into the path of movement of the two insulating material lugs for the insulating material lugs to move the contact webs resiliently away from the connecting elements as the plug component approaches the operative position thereof relative to the socket component to interrupt the short-circuit connection.

It is particularly advantageous when the contact webs are bent out of the end portions of the arms of the U-shaped spring while the remainders of the end portions of the arms constitute the actuating portions and have inclined ramp surfaces which come into contact with the insulating material lugs of the socket component as the plug component approaches the operative position thereof relative to the socket component.

As a result of the above-discussed construction of the arrangement of the present invention, the short-circuit bridge in its entirety is a very simple shaped element which can be as such simply and easily mounted in the receiving space of the plug component, for instance, by laying it in or inserting it into the receiving space. Herein, this simple shaped spring element or part has as small a consumption of available space as conceivable or feasible as a result of its configuration as well as of its arrangement between the two connecting elements.

Moreover, despite the simplicity and ease with which this simple shaped spring element can be accommodated in the plug component, it can still operate with a high degree of reliability due to the provision of the free end portions of the respective arms of the spring element which extend out of or beyond the receiving space, that is, on the one hand, the contact webs thereof can cooperate, if so desired, with the inwardly facing surfaces of the connecting elements in the sense of establishing the short-circuit connection between the connecting element and, on the other hand, if so desired, the contact webs and thus the entire spring element can be resiliently brought out of contact with the connecting elements by the displacing action of the insulating material lugs of the socket component on the end portions of the arms of the spring element and more particularly on the actuating portions thereof, so that the short-circuit connection is eliminated.

BRIEF DESCRIPTION OF THE DRAWING

The present invention will be described below in more detail with reference to the sole FIGURE of the accompanying drawing which is a simplified longitudinal section of an electrical double plug and socket connector according to the present invention, indicating various positions of socket and plug components of the arrangement and corresponding effects on a short-circuit bridge.

DETAILED DESCRIPTION OF THE PREFERRED EMBODIMENT

Referring now to the sole FIGURE of the drawing in detail, it may be seen that the reference numeral 1 has been used therein to identify a plug component of a double plug and socket connector of the present invention. The plug component 1 has an insulating material housing 2 of an electrically insulating material. Two electrically conductive contact elements 3 are arranged in the insulating material housing 2. Electrically conductive metallic connecting elements 4 are fixed or fixable in position relative to the contact elements 3 and project out of these contact elements 3. In the illustrated construction, the connecting elements 4 are pin-shaped.

An elongated receiving space 5 is formed at the central region of the plug component 1, that is, in the illustrated construction, between the contact elements 3. This central receiving space 5 serves for receiving a predominant part of a short-circuit bridge which has the shape of an approximately U-shaped spring 6. The U-shaped spring 6 is inserted into the receiving space 5 during the assembly of the plug component 1 in a simple manner and so that the spring 6 is predominantly, and thus with a sufficiently good seat, received in the receiving space 5.

Contact webs 7 are bent out of the spring material of the U-shaped spring 6 at the free end portions of the spring 6 that project out of the receiving space 5, so as to point in the outward direction. When the plug connection is not effectuated, the respective contact webs 7 resiliently contact, due to the spring action of the U-shaped spring 6, the mutually opposite inner sides of the connecting element 4, as indicated in the lower half of the drawing. Furthermore, the free arm end portions of the U-shaped spring 6 are shaped as actuating portions 8 which are provided with inclined ramp surfaces 9. Then, insulating material portions of a socket component can act on the actuating portions 8 and on their inclined ramp surfaces 9 in a manner which will be described later.

The electrical double plug and socket connector arrangement further includes a socket component 10 including an insulating housing 11 of an electrically insulating material. Two contacts 12 of an electrically conductive material are arranged in the insulating material housing 11 and are capable of cooperating with the connecting element 4 of the plug component 1.

Furthermore, insulating material lugs 13 are provided on the insulating material housing 11 of the socket component 10. The insulating material lugs 13 are arranged oppositely to one another and inwardly from the respective two contacts 12. The above-mentioned actuating portions 8 with the inclined ramp surfaces 9 at the free arm end portions of the U-shaped spring 6 mounted in the plug component 1 are situated in the path of movement of the insulating material lugs 13 as the components 1 and 10 approach their fully assembled position relative to one another.

The arrangement is chosen in such a manner that the connecting portions 4 project farther beyond the end of the U-shaped spring 6 than the insulating material lugs 13 project beyond the contacts 12.

When the socket component 10 is not plugged in into the plug component 1, the contact webs 7 resiliently contact the connecting elements 4 in the plug component 1 in the sense of the formation of a short-circuit connection. Then, when the socket component 10 is plugged in into the plug component 1, there is initially obtained, during a first phase, only a mutual reliable guidance of the corresponding guiding sections of the insulating material housings 2 and 11 of the plug and the socket components 1 and 10 on each other, as indicated in the lower half of the drawing in solid lines.

Thereafter, during a second insertion phase, there is already obtained a contact of the contacts 12 of the socket component 10 with the free end regions of the connecting elements 4 of the plug component 1, as shown in the lower half of the drawing in dashed lines. In spite of this, however, the contact webs 7 of the U-shaped spring 6 still remain in a resilient contact with the connecting elements 4 in the sense of maintaining the short-circuit connection.

Then, during the further insertion of the plug component 1 and socket component 10 into one another, the insulating material lugs 13 of the insulating material housing 11 of the socket component 10 come into contact with the inclined ramp surfaces 9 of the actuating portions 8 of the free arm ends of the U-shaped spring 6 as indicated in dash-dotted lines in the lower half of the drawing. Thereafter, during the final phase of the mutual insertion of the plug and socket components 1 and 10, the forward regions of the insulating material lugs 13 resiliently ride over the actuating portions 8, with attendant lifting of the contact webs 7 from the connecting elements 4 and resulting discontinuance of the short-circuit connection, to reach the position illustrated in the upper half of the drawing.

As a result of the accommodation of the U-shaped spring 6 over a considerable part of its length in the correspondingly shaped receiving space 5, the U-shaped spring 6 has, despite the simplicity of the corresponding mounting thereof, has a functionally proper hold in the plug component 1 and also requires here only a small amount of space between the connecting elements 4 and the contact elements 3.

While the present invention has been described and illustrated herein as embodied in a specific construction of a double plug and socket connector, it is not limited to the details of this particular construction, since various modifications and structural changes are possible and contemplated by the present invention. Thus, the scope of the present invention will be determined exclusively by the appended claims.

What is claimed is:

1. An electrical double plug and socket connector comprising a socket component including a first insulating material housing centered on an axis and having two axially spaced ends, two metallic contacts arranged in said first insulating material housing, and insulating material lugs mounted on said first insulating material housing and projecting substantially axially from one of said ends to a predetermined distance beyond said contacts;

a plug component guided on said socket component for axial movement between at least one inoperative and one operative position and including a second insulating material housing having two spaced axial ends one of which faces said one end of said socket component in said positions and bounding a centrally located receiving space which is open toward said one axial end of said plug component, and two metallic connecting elements arranged in said second insulating material housing outwardly of and projecting axially beyond said receiving space and each having an inwardly facing surface portion; and a resilient short-circuit bridge including a substantially U-shaped spring arranged between the two connecting elements, predominantly accommodated in said receiving space of said second insulating material housing, and having two arms having respective end portions projecting axially out of said receiving space toward said insulating material lugs of said first insulating material housing to such an extent that said connecting elements project beyond said end portions of said arms by more than said predetermined distance, said end portions of said arms having respective contact webs which respectively extend toward and resiliently contact the associated ones of said inwardly facing surface portions of said connecting elements in said inoperative position for the short-circuit bridge to provide a short-circuit connection between said connecting elements, and actuating portions which respectively extend into the path of movement of said two insulating material lugs for said insulating material lugs to move said contact webs resiliently away from said connecting elements as said plug component approaches said operative position thereof relative to said socket component to interrupt said short-circuit connection.

2. The electrical double plug and socket connector as defined in claim 1, wherein said contact webs are bent out of said end portions of said arms of said U-shaped spring while the remainders of said end portions of said arms constitute said actuating portions and have inclined ramp surfaces which come into contact with said insulating material lugs of said socket component as said plug component approaches said operative position thereof relative to said socket component.

* * * * *